US006190004B1

(12) United States Patent
Minemoto et al.

(10) Patent No.: US 6,190,004 B1
(45) Date of Patent: Feb. 20, 2001

(54) INKJET RECORDING APPARATUS

(75) Inventors: Hitoshi Minemoto; Yoshihiro Hagiwara; Tadashi Mizocuchi; Junichi Suetsugu; Hitoshi Takemoto; Kazuo Shima; Toru Yakushiji, all of Niigata (JP)

(73) Assignee: NEC Corporation, Tokyo (JP)

( * ) Notice: Under 35 U.S.C. 154(b), the term of this patent shall be extended for 0 days.

(21) Appl. No.: 09/120,157

(22) Filed: Jul. 21, 1998

(30) Foreign Application Priority Data

Jul. 22, 1997 (JP) ..... 9-195764

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292, 293, 294, 295

(56) References Cited

U.S. PATENT DOCUMENTS 4,684,957 8/1987 Miura et al. .
4,700,204 10/1987 Nakayama .
5,754,200 * 5/1998 Minemoto et al. ..... 347/55

FOREIGN PATENT DOCUMENTS 0774354 5/1997 (EP) .
62-13379 1/1987 (JP) .
1-204750 8/1989 (JP) .
2-198855 8/1990 (JP) .
9-164669 6/1997 (JP) .

OTHER PUBLICATIONS

Japanese Office Action issued Apr. 27, 1999 in a related application.
English–language translation of relevant portions of Apr. 27, 1999 JPO Office Action.
Patent Abstracts of Japan, vol. 013, No. 506 (M–892), Nov. 14, 1989 & JP 01 204750 A (Ricoh Co Ltd), Aug. 17, 1989 *Abstract*.

* cited by examiner

*Primary Examiner*—John Barlow
*Assistant Examiner*—Raquel Yvette Gordon
(74) *Attorney, Agent, or Firm*—Ostrolenk, Faber, Gerb & Soffen, LLP

(57) ABSTRACT

An inkjet recording apparatus includes a plurality of ejection electrodes and a counter electrode which are controlled at predetermined intervals such that a first voltage pulse is applied to a selected ejection electrode depending on input data and a second voltage pulse is applied to the counter electrode in synchronization with the first voltage pulse. The first and second voltage pulses produce a voltage difference between the selected ejection electrode and the second electrode, wherein the voltage difference is not smaller than a predetermined threshold voltage which is a minimum value which causes ejection of particulate matter from the selected ejection electrode.

18 Claims, 4 Drawing Sheets

$$\left( \begin{array}{l} V_B < V_{OS1} < V_{TH} \\ V_{P1} + V_{OS1} \geqq V_{TH} \end{array} \right)$$

INKJET RECORDING APPARATUS

BACKGROUND OF THE INVENTION

1. Field of the Invention

The present invention relates to an inkjet recording apparatus which is capable of ejecting particulate matter such as pigment matter and toner matter by making use of an electric field, and more particularly to voltage control for the inkjet recording apparatus.

2. Description of the Related Art

There has recently been a growing interest in non-impact recording methods, because noise while recording is extremely small to such a degree that it can be neglected. Particularly, inkjet recording methods are extremely effective in that they are structurally simple and that they can perform high-speed recording directly onto ordinary medium. As one of the inkjet recording methods, there is an electrostatic inkjet recording method.

The electrostatic inkjet recording apparatus generally has an electrostatic inkjet recording head and a counter electrode which is disposed behind the recording medium to form an electric field between it and the recording head. The electrostatic inkjet recording head has an ink chamber which temporarily stores ink containing toner particles and a plurality of ejection electrodes formed near the end of the ink chamber and directed toward the counter electrode. The ink near the front end of the ejection electrode forms a concave meniscus due to its surface tension, and consequently, the ink is supplied to the front end of the ejection electrode. If positive voltage relative to the counter electrode is supplied to a certain ejection electrode of the head, then the particulate matter in ink will be moved toward the front end of that ejection electrode by the electric field generated between the ejection electrode and the counter electrode. When the coulomb force due to the electric field between the ejection electrode and the counter electrode considerably exceeds the surface tension of the ink liquid, the particulate matter reaching the front end of the ejection electrode is jetted toward the counter electrode as an agglomeration of particulate matter having a small quantity of liquid, and consequently, the jetted agglomeration adheres to the surface of the recording medium. Thus, by applying pulses of positive voltage to a desired ejection electrode, agglomerations of particulate matter are jetted in sequence from the front end of the ejection electrode, and printing is performed.

A first example of such an electrostatic inkjet recording apparatus has been disclosed in Japanese Patent Unexamined Publication No. 62-13379. According to this conventional apparatus, a pulse voltage of one of positive and negative polarities and a predetermined pulse width is applied to the counter electrode to achieve stable inkjet recording regardless of ink resistance.

A second example has been disclosed in Japanese Patent Unexamined Publication No. 1-204750. This conventional apparatus is provided with a bias means and a pressure generating mechanism. The bias means applies a constant bias voltage to a counter electrode. The pressure generating mechanism periodically presses an ink chamber to form constant meniscuses at the ejection nozzle. With the constant bias voltage applied, a recording pulse is further applied to a selected one of the recording electrode in synchronization with the periodical pressing operation of the pressure generating mechanism.

In the first conventional example (Publication NO, 62-13379), however, the pulse voltage is applied to the counter electrode so as to inject charges into ink meniscuses regardless of the recording pulse signal for ejecting ink from the recording electrode. In other words, the pulse voltage applied to the counter electrode is not designed for ink ejection.

On the other hand, the second conventional example (Publication NO. 1-204750) needs the pressure generating mechanism for periodically presses the ink chamber to form constant meniscuses at the ejection nozzle. Therefore, the structure of the inkjet head becomes complicated, resulting in increased cost. Further, the bias voltage is continuously applied to the counter electrode during inkjet recording operation.

SUMMARY OF THE INVENTION

It is an objective of the present invention to provide an inkjet recording apparatus which can reliably and stably eject ink from an ejection electrode with miniaturization and cost reduction of control circuit.

According to an aspect of the present invention, an inkjet recording apparatus is comprised of an ink chamber containing ink including particulate matter, an electrophoresis electrode placed in a side of the ink chamber, a plurality of ejection electrodes arranged in the ink chamber, and a counter electrode placed at a predetermined distance from the ejection electrodes which are directed to the second electrode. In such a constitution, a controller controls the ejection electrodes and the counter electrode at predetermined intervals such that a first voltage pulse is applied to a selected ejection electrode depending on input data and a second voltage pulse is applied to the counter electrode in synchronization with the first voltage pulse, wherein the first and second voltage pulses produce a voltage difference between the selected ejection electrode and the second electrode, wherein the voltage difference is not smaller than a predetermined threshold voltage which is a minimum value which causes ejection of particulate matter from the selected ejection electrode.

The controller may control the electrophoresis electrode such that a constant voltage is applied to the electrophoresis electrode to produce a voltage difference between the electrophoresis electrode and the counter electrode so as to cause electrophoresis of the particulate matter in the ink chamber.

As described above, since the first and second voltage pulses produce the voltage difference between the selected ejection electrode and the second electrode, the voltage applied to each ejection electrode can be lowered, resulting in enhanced miniaturization and cost reduction.

Further, in the case where a voltage difference is produced between the electrophoresis electrode and the counter electrode so as to cause electrophoresis of the particulate matter, the voltage difference between the electrophoresis electrode and the counter electrode varies according to the second voltage pulse applied to the counter electrode. Therefore, an appropriate amount of meniscus can be formed at the front end of each ejection electrode.

BRIEF DESCRIPTION OF THE DRAWINGS

The above and other objects and advantages will become apparent from the following detailed description when read in conjunction with the accompanying drawings wherein.

DETAILED DESCRIPTION OF THE PREFERRED EMBODIMENT

Figure 1:
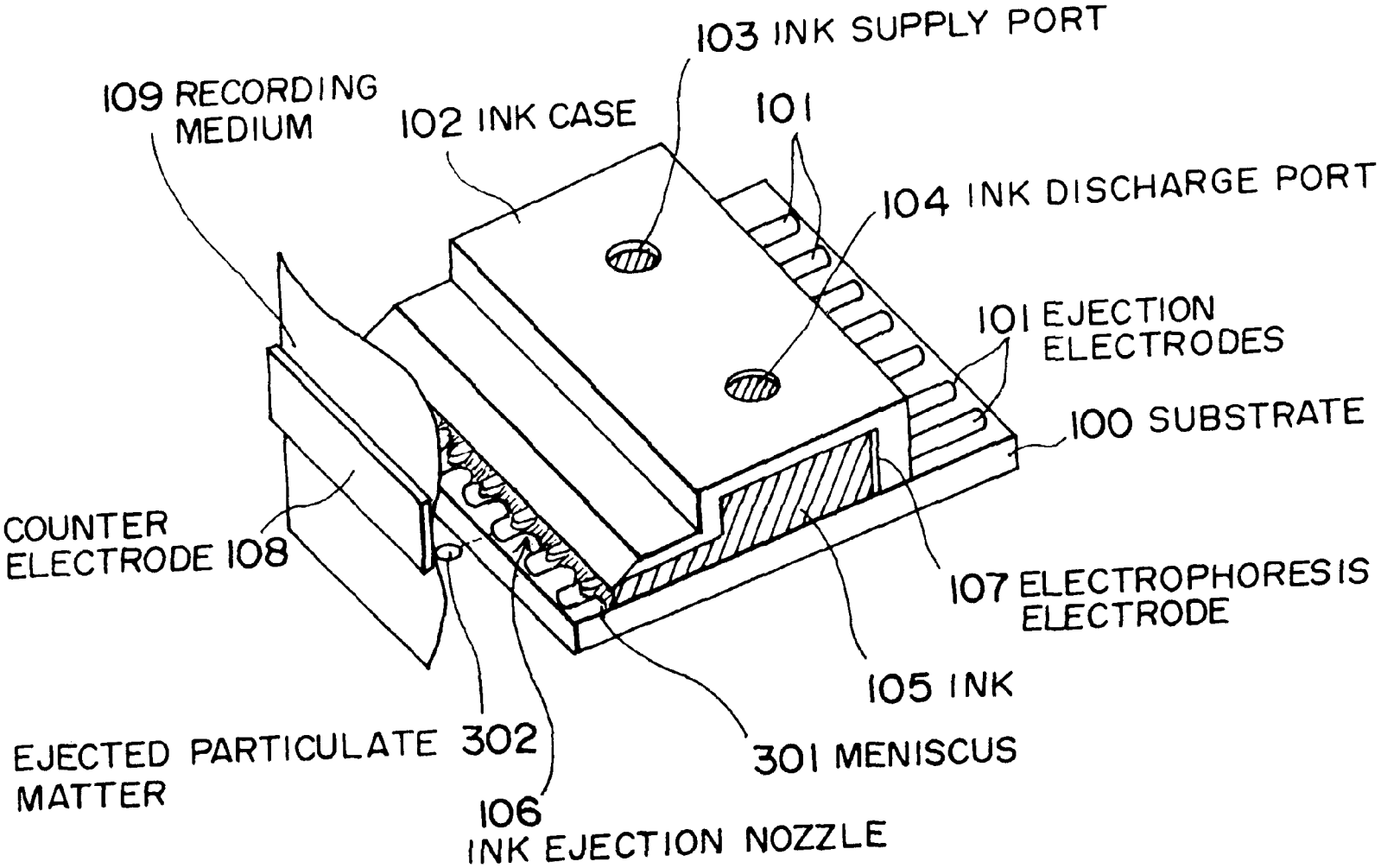
FIG. 1 is a part-fragmentary perspective view showing the schematic constitution of an inkjet head used in an inkjet recording apparatus according to the present invention.

Referring to FIGS. 1A and 1B, there is shown an electrostatic inkjet recording head to which the present invention can be applied. A substrate 100 is made of an insulator such as plastic and has a plurality of needle-like ejection electrodes 101 formed thereon in accordance with a predetermined pattern. The portions of the ejection electrodes 101 in the ink chamber are covered with an insulating film. An ink case 102 made of an insulating material is mounted on the substrate 100. The ink case 102 is formed with an ink supply port 103 and an ink discharge port 104. The space, defined by the substrate 100 and the ink case 102, constitutes an ink chamber which is filled with ink 105 containing pigment matter or toner particles which is supplied through the ink supply port 103. The front end of the ink case 102 is cut out to form a slit-line nozzle 106 between the ink case 102 and the substrate 100. The ejection ends of the ejection electrodes 101 are disposed in the nozzle 106.

At the inner rear end of the ink case 102, an electrophoresis electrode 107 is provided within the ink chamber. The ejection electrodes 101 are directed to a counter electrode 108 on which a recording medium 109 is placed. As will be described later, a positive voltage $V_D$ is applied to the electrophoresis electrode 107 and a periodical pulse of a negative voltage $-V_{OS}$ with respect to a negative bias voltage $-V_B$ which is higher than $-V_{OS}$ is applied to the counter electrode 108. If a voltage with the same polarity as toner particles is applied to the electrophoresis electrode 107, then an electric field will be generated in the ink chamber. This causes toner particles to be moved toward the front end of the ejection electrodes 101 due to the electrophoresis phenomenon to form ink meniscus 301. In this state, when an ejection voltage pulse of positive voltage $V_P$ is applied to an ejection electrode to generate a voltage difference more than a threshold voltage $V_{TH}$ between the ejection electrode and the counter electrode 108, the particulate matter 302 is jetted from the front end of that ejection electrode to the recording medium 109.

Figure 2:
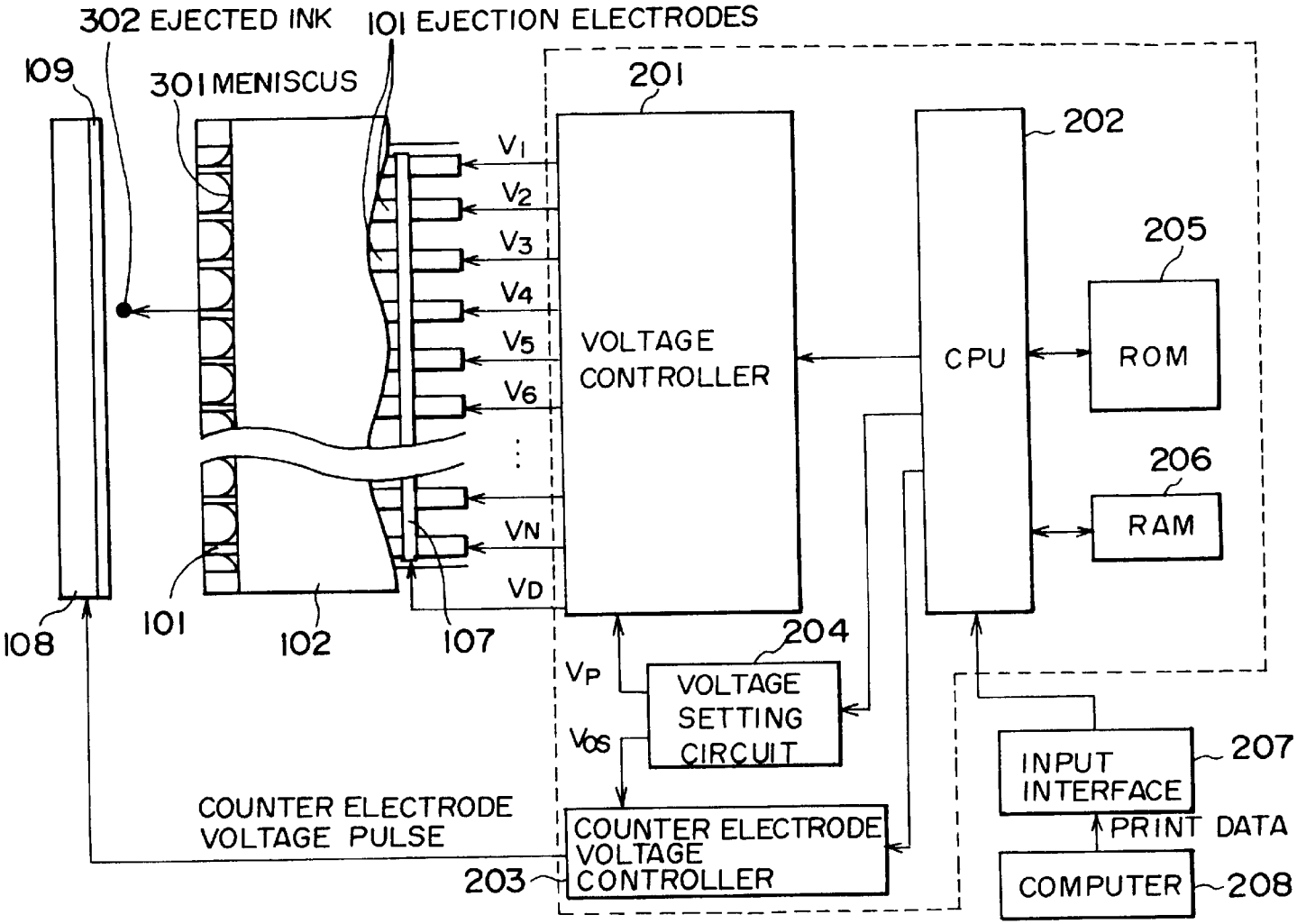
FIG. 2 is a block diagram showing the circuit configuration of an inkjet recording apparatus according to a first embodiment according to the present invention.

FIG. 2 shows a control circuit of the inkjet recording apparatus, where elements of the inkjet device similar to those previously described with reference to FIG. 1 are denoted by the same reference numerals.

In the control circuit, a voltage controller 201 generates control voltages $V_1$–$V_N$ under the control of a processor (CPU) 202 and outputs them to the ejection electrodes 101, respectively. Each of the control voltages $V_1$–$V_N$ is set to a positive voltage $V_P$ when it is selected to eject ink and to a low voltage (here, ground voltage) when not selected. A counter electrode voltage controller 203 normally applies a negative bias voltage $-V_B$ and, at the timing that the positive voltage $V_P$ is applied to the selected ejection electrode, applies the counter electrode pulse voltage $-V_{OS}$ lower than $-V_B$ to the counter electrode 108 under the control of the processor 202. The positive voltage $V_P$ and the counter electrode pulse voltage $-V_{OS}$ are set by a voltage setting circuit 204.

The processor 202 performs the drive control of the inkjet device according to a control program stored in a read-only memory 205 and controls the voltage controller 201 depending on print data and print control signal stored in a random access memory 206, which are received from a computer 208 through an input interface 207. More specifically, the processor 202 selects one or more (or none) of the ejection electrodes 101 depending on the print data and controls the voltage controller 201 so that the positive voltage $V_P$ is output to a selected ejection electrode.

Further, the processor 202 instructs the voltage controller 201 to apply a predetermined positive voltage $V_D$ to the electrophoresis electrode 107 after power-on. The predetermined voltage $V_D$ applied to the electrophoresis electrode 107 causes an electric field to be generated in the ink chamber. The electric field moves the particulate matter such as pigment particles toward the front end of the ejection electrodes 101 due to the electrophoresis phenomenon and then the meniscuses 301 are formed around the ejection electrodes 101, respectively. The voltage control of the ejection electrodes 101 and the counter electrode 108 will be described in detail hereinafter.

In general, the ink ejection from an ejection electrode requires that a voltage difference between the ejection electrode and the counter electrode 108 is equal to or greater than a predetermined threshold value $V_{TH}$. If the voltage difference is smaller than the threshold value $V_{TH}$, the ink ejection from that ejection electrode cannot occur. Therefore, by the processor 202 and the voltage setting circuit 204 controlling the voltage difference between each ejection electrode and the counter electrode 108, the ejection electrodes selectively eject ink particles. In the embodiment, the counter electrode voltage controller 203 applies the counter electrode voltage$-V_{OS}$ lower than the negative bias voltage $-V_B$ to the counter electrode 108 in synchronization with the timing of the ejection electrode pulse.

Figure 3A:
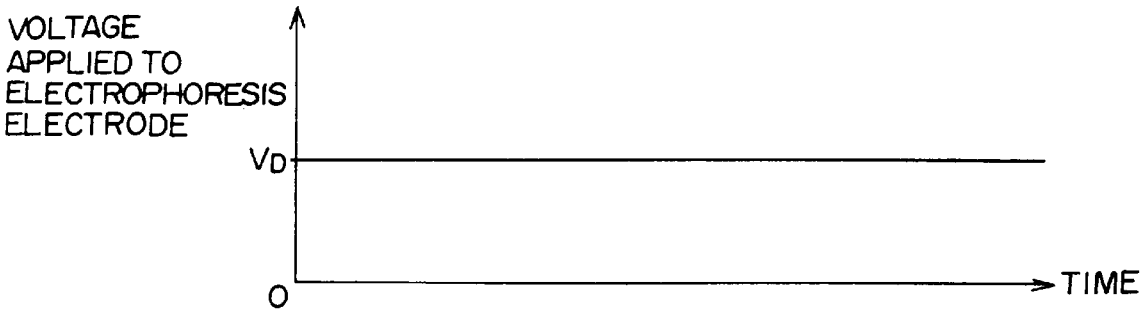
FIG. 3A is a waveform diagram showing a voltage applied to the electrophoresis electrode of the inkjet recording apparatus according to the first embodiment.
Figure 3B:
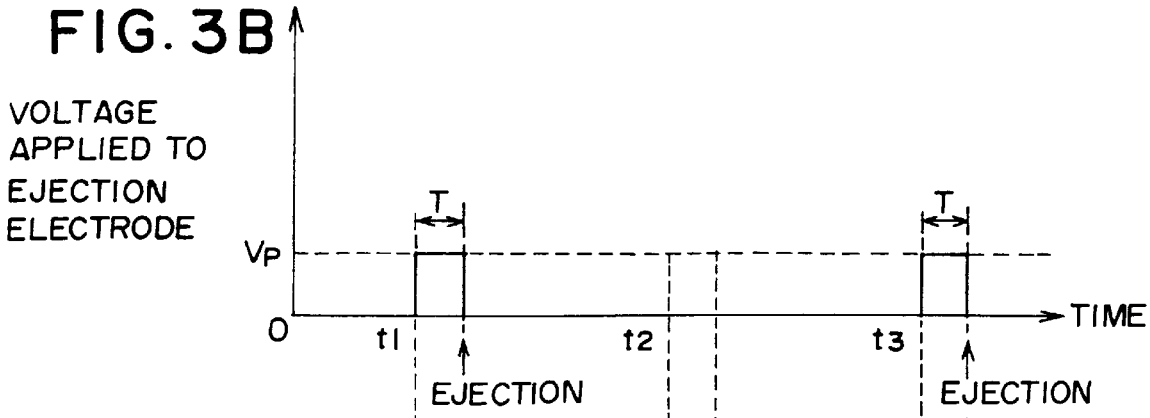
FIG. 3B is a waveform diagram showing a pulse voltage applied to an ejection of the inkjet recording apparatus according to the first embodiment.
Figure 3C:
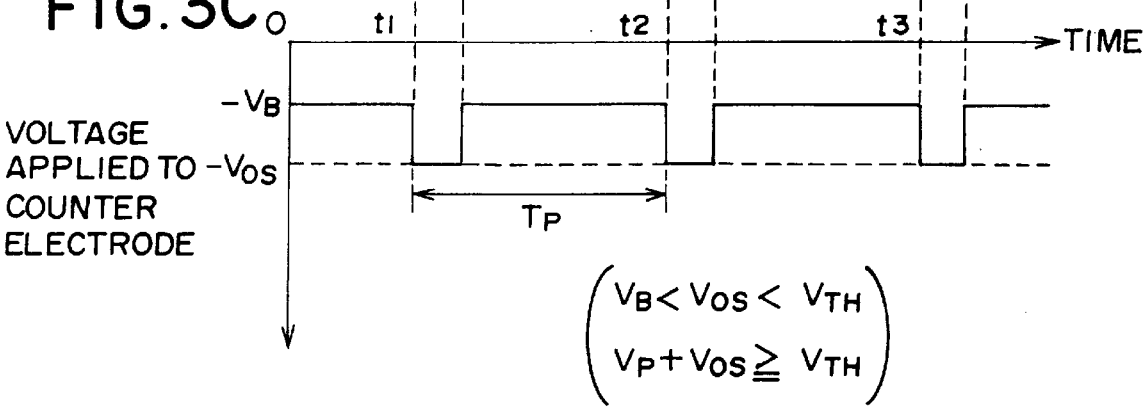
FIG. 3C is a waveform diagram showing a voltage applied to the counter electrode of the inkjet recording apparatus according to the first embodiment.

Referring to FIGS. 3A–3C, when powered, the processor 202 controls the voltage controller 201 and the counter electrode voltage controller 203 such that the predetermined positive voltage $V_D$ is applied to the electrophoresis electrode 107 and the negative bias voltage $-V_B$ to the counter electrode 108 (see FIGS. 3A and 3C).

Thereafter, when receiving print data and print control data, the processor 202 controls the voltage controller 201 such that an ejection electrode pulse having the positive voltage $V_P$ and a pulse width of T is applied to a selected ejection electrode depending on the print data (see FIG. 3B) and the counter electrode pulse of the negative voltage $-V_{OS}$ is applied to the counter electrode 108 in synchronization with the timing of the ejection electrode pulse.

More specifically, the counter electrode voltage controller 203 applies the counter electrode pulse of $-V_{OS}$ to the counter electrode 108 at intervals of $T_P$. In this case, the interval of ink ejection by each ejection electrode is set to the time period of $T_P$. Since the counter electrode pulse of the negative voltage $-V_{OS}$ is periodically applied and the negative bias voltage $-V_B$ is normally applied to the counter electrode 108, the meniscuses 301 around the ejection electrodes 101 are prevented from a withdrawal in a rear direction and, when the positive voltage $V_P$ is applied to the selected ejection electrode, the meniscuses 301 including an appropriate amount of the particulate matter can be optimally formed.

For example, at a time instant t1, the ejection electrode pulse rises to the positive voltage $V_P$ and the counter electrode pulse falls from the negative bias voltage $-V_B$ to the negative voltage $-V_{OS}$. And then after a lapse of time period T, the ejection electrode pulse falls to the ground voltage and the counter electrode pulse rises from the negative voltage $-V_{OS}$ to the negative bias voltage $-V_B$. On the other hand, assuming that the ejection electrode is not selected at a time instant t2, the ejection electrode pulse does not change but the counter electrode pulse falls from the negative bias voltage $-V_B$ to the negative voltage $-V_{OS}$. And then after a lapse of time period T, the counter electrode pulse rises from the negative voltage $-V_{OS}$ to the negative bias voltage $-V_B$. In this case, the voltage difference between the ejection electrode and the counter electrode 108 is only $V_{OS}$ which is smaller than the threshold voltage $V_{TH}$. Therefore, no ink is jetted from the ejection electrode.

As described before, the ink ejection occurs only when a voltage difference between the ejection electrode and the counter electrode 108 is equal to or greater than the threshold voltage $V_{TH}$. Therefore, in the case where the ejection pulse is applied to a selected ejection electrode, that is, $V_P+V_{OS} \geqq V_{TH}$, the selected ejection electrode ejects ink particles on the falling edge of each ejection electrode pulse as shown in FIG. 3B. In other cases. Since $V_B<V_{OS}<V_{TH}$, no ink ejection occurs.

Figure 4A:
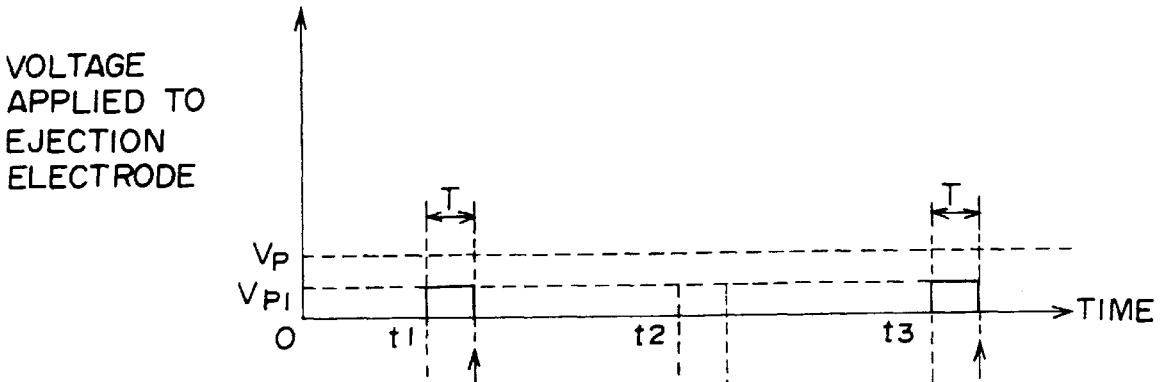
FIG. 4A is a waveform diagram showing another example of a pulse voltage applied to an ejection electrode of the inkjet recording apparatus according to the first embodiment.
Figure 4B:
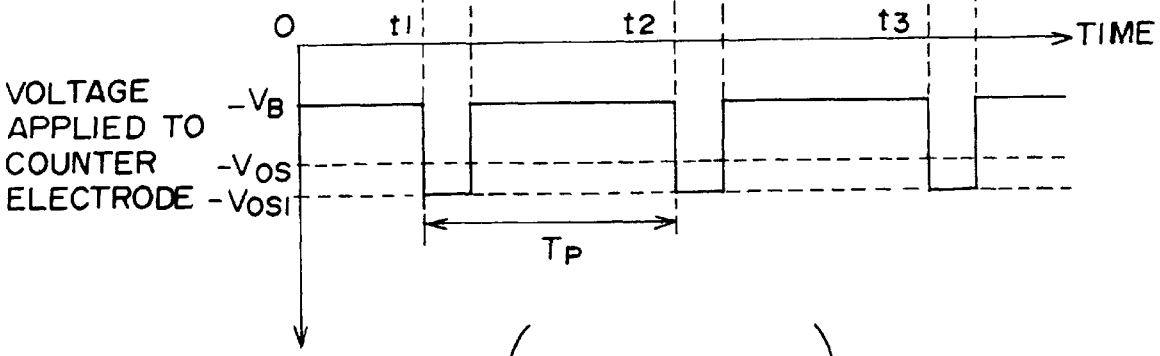
FIG. 4B is a waveform diagram showing another example of a voltage applied to the counter electrode of the inkjet recording apparatus according to the first embodiment.

As shown in FIGS. 4A and 4B, the ejection electrode pulse voltage $V_P$ and the counter electrode pulse voltage $-V_{OS}$ are set to lower voltages, $V_{P1}$ and $-V_{OS1}$, respectively. The other conditions are the same as the case shown in FIGS. 3A–3C. Therefore, in the case where the ejection pulse is applied to a selected ejection electrode, that is, $V_{P1}+V_{OS1} \geqq V_{TH}$, the selected ejection electrode ejects ink particles on the falling edge of each ejection electrode pulse as shown in FIG. 4A. In other cases, since $V_B<V_{OS1}<V_{TH}$, no ink ejection occurs.

It should be noted that the respective voltages are set such that the ink ejection occurs only when a voltage difference between the ejection electrode and the counter electrode 108 is equal to or greater than the threshold voltage $V_{TH}$. Therefore, the voltages $V_D$, $V_P$ and $V_{P1}$ and the negative voltages $-V_B$, $-V_{OS}$ and $-V_{OS1}$ should be relatively set so as to satisfy the above relationship. In other words, there is no need to set the voltages applied to the counter electrode 108 to negative voltages as described above.

While the invention has been described with reference to the specific embodiment thereof, it will be appreciated by those skilled in the art that numerous variations, and modifications are possible, and accordingly, all such variations, modifications, and combinations are to be regarded as being within the scope of the invention.

What is claimed is:

1. An inkjet recording apparatus comprising:

an ink chamber containing ink including particular matter;

an electrophoresis electrode located in the ink chamber;

a plurality of ejection electrodes arranged in the ink chamber;

a counter electrode spaced from the ejection electrodes; and a controller for controlling the ejection electrodes and the counter electrode such that a first voltage pulse is applied to selected ones of the ejection electrodes as a function of input data and a second voltage pulse is applied to the counter electrode in synchronization with the first voltage pulse to produce a voltage difference between the selected ejection electrodes and the counter electrode, the voltage difference being greater than a predetermined threshold voltage necessary to eject particulate matter from the selected ejection electrodes toward the counter electrode.

2. The inkjet recording apparatus according to claim 1, wherein the controller comprises:

a first voltage controller for applying the first voltage pulse to the selected ejection electrodes as a function of the input data at predetermined intervals; and a second voltage controller for applying the second voltage pulse to the counter electrode at the same predetermined intervals.

3. The inkjet recording apparatus according to claim 1, wherein the controller further controls the electrophoresis electrode such that a constant voltage is applied to the electrophoresis electrode to produce a voltage difference between the electrophoresis electrode and the counter electrode so as to cause electrophoresis of the particulate matter in the ink chamber.

4. The inkjet recording apparatus according to claim 3, wherein the second voltage pulse changes from a bias voltage to a pulse voltage at predetermined intervals, each pulse voltage having a constant pulse width, the bias voltage producing voltage difference between the electrophoresis electrode and the counter electrode so as to cause electrophoresis of the particulate matter in the ink chamber.

5. The inkjet recording apparatus according to claim 1, wherein the second voltage pulse changes from a bias voltage to a pulse voltage at predetermined intervals, each pulse voltage having a constant pulse width.

6. The inkjet recording apparatus according to claim 1, wherein the first and second voltage pulses are each set to arbitrary voltages while maintaining the voltage difference between them.

7. The inkjet recording apparatus according to claim 6, wherein the controller comprises:

a first voltage controller for applying the first voltage pulse to the selected ejection electrodes as a function of the input data at the predetermined intervals; and a second voltage controller for applying the second voltage pulse to the counter electrode at the predetermined intervals.

8. The inkjet recording apparatus according to claim 6, wherein the controller further controls the electrophoresis electrode such that a constant voltage is applied to the electrophoresis electrode to produce a voltage difference between the electrophoresis electrode and the counter electrode so as to cause electrophoresis of the particulate matter in the ink chamber.

9. The inkjet recording apparatus according to claim 8, wherein the second voltage pulse changes in voltage from a bias voltage to a pulse voltage during a predetermined pulse width at predetermined intervals, the bias voltage producing a voltage difference between the electrophoresis electrode and the counter electrode so as to cause electrophoresis of the particulate matter in the ink chamber.

10. The inkjet recording apparatus according to claim 6, wherein the second voltage pulse changes in voltage from a bias voltage to a pulse voltage during a predetermined pulse width at the predetermined intervals.

11. A method for controlling an inkjet recording apparatus of the type which includes an ink chamber containing ink which includes particulate matter; an electrophoresis electrode placed in a side of the ink chamber; a plurality of ejection electrodes arranged in the ink chamber; and a counter electrode from the ejection electrodes; the method comprising:

applying a first voltage pulse to selected ejection electrodes as a function of input data at predetermined intervals; and applying a second voltage pulse to the counter electrode in synchronization with the first voltage pulse, such that the first and second voltage pulses produce a voltage difference between the selected ejection electrodes and the counter electrode, the voltage difference being larger than a predetermined threshold voltage necessary to eject particulate matter from the selected ejection electrode toward the counter electrode.

12. The control method according to claim 11, further comprising the step of:

applying a constant voltage to the electrophoresis electrode to produce a voltage difference between the electrophoresis electrode and the counter electrode so as to cause electrophoresis of the particulate matter in the ink chamber.

13. The control method according to claim 12, wherein the second voltage pulse changes from a bias voltage to a pulse voltage during a predetermined pulse width at the predetermined intervals, wherein the bias voltage produces voltage difference between the electrophoresis electrode and the counter electrode so as to cause electrophoresis of the particulate matter in the ink chamber.

14. The control method according to claim 11, wherein the second voltage pulse changes in voltage from a bias voltage to a pulse voltage at predetermined intervals, each pulse voltage having a predetermined pulse width.

15. The control method according to claim 11, further comprising:

setting the first and second voltage pulses to arbitrary voltages while maintaining the voltage difference between them before applying the first and second voltage pulses.

16. The control method according to claim 15, further comprising the step of:

applying a constant voltage to the electrophoresis electrode to produce a voltage difference between the electrophoresis electrode and the counter electrode so as to cause electrophoresis of the particulate matter in the ink chamber.

17. The control method according to claim 16, wherein the second voltage pulse changes from a bias voltage to a pulse voltage at predetermined intervals, each pulse voltage having a constant pulse width, the bias voltage producing a voltage difference between the electrophoresis electrode and the counter electrode so as to cause electrophoresis of the particulate matter in the ink chamber.

18. The control method according to claim 15, wherein the second voltage pulse changes from a bias voltage to a pulse voltage during a predetermined pulse width at the predetermined intervals.

* * * * *